United States Patent [19]

Rogers

[11] 3,952,273

[45] Apr. 20, 1976

[54] HIGH VOLTAGE SWITCH MECHANISM

[75] Inventor: Edward J. Rogers, Chicago, Ill.

[73] Assignee: S & C Electric Company, Chicago, Ill.

[22] Filed: Apr. 1, 1975

[21] Appl. No.: 563,965

[52] U.S. Cl. ..... 337/7; 337/8; 337/146

[51] Int. Cl.[2] ..... H01H 85/00

[58] Field of Search ..... 337/7, 8, 9, 11, 146, 337/194, 208, 245, 402, 404, 405, 410; 200/50

[56] References Cited

UNITED STATES PATENTS

| | | | |
|---|---|---|---|
| 3,400,353 | 9/1968 | Schockelt | 337/7 |
| 3,530,418 | 9/1970 | Keogh et al. | 337/8 X |
| 3,576,509 | 4/1971 | Bernatt | 337/8 |
| 3,790,861 | 2/1974 | Sakats | 337/8 |
| 3,842,381 | 10/1974 | Bernatt | 337/7 |

*Primary Examiner*—J. D. Miller
*Assistant Examiner*—Fred E. Bell
*Attorney, Agent, or Firm*—Kirkland & Ellis

[57] ABSTRACT

Disclosed is an interrupter switch mechanism for interrupting current flow in a high voltage electrical circuit. A tubular switch blade is mounted for linear movement to engage and disengage a stationary contact. A spring is positioned within the hollow interior of the tubular switch blade so that it can be biased in either direction by sliding plugs also positioned within the tubular switch blade. The sliding plugs include pins which engage a slot in a plate member so that movement of the plate member in either direction causes one or the other of the plugs to move to bias the spring in that direction. The plate member has gear teeth formed thereon for engaging mating teeth on a tool engaging disk. The tool engaging disk has an opening therein for engaging the end of an insulated tool which may be rotated to operate the mechanism. The plate member also has cam surfaces which engage first and second cam follower members to cause these cam follower members to pivot. The cam follower members also include stop arms which engage the tubular switch blade and prevent it from moving until the spring is fully biased and then releases the switch blade so that the switch blade will move rapidly to either engage or disengage the stationary contact. The invention may also include fuse contact members which are operated by the tool engaging disk to engage a fuse or other electrical component when the tool engaging disk is rotated in one direction and to disengage the fuse or component when the tool engaging disk is pivoted in the opposite direction.

11 Claims, 9 Drawing Figures

A
B
C
D

HIGH VOLTAGE SWITCH MECHANISM

BACKGROUND OF THE INVENTION

1. Field of the Invention

The present invention relates to high voltage interrupter switch mechanisms, and more particularly, the present invention relates to a high voltage interrupter switch mechanism mounted in metal-enclosed high voltage pad-mounted switchgear and adapted for use in conjunction with an insulated tool which may also be used to withdraw fuses from the switchgear.

2. Description of the Prior Art

High voltage pad-mounted switchgear arrangements are well known in the art. For example, U.S. Pat. No. 3,842,381 - Bernatt et al., entitled "INTEGRAL FUSE AND SWITCH SUPPORT FOR METAL-ENCLOSED SWITCHGEAR", issued Oct. 15, 1974 and assigned to the same assignee as the present invention discloses one type of metal-enclosed switchgear having drawout fuses and individual isolating fuse operating mechanisms. However, in this arrangement, operation of the isolator switch requires a separate operation.

Also, U.S. Pat. No. 3,576,509 - Bernatt, entitled "METAL-ENCLOSED LOOP SWITCHES WITH DRAWOUT FUSES, FUSE ISOLATOR SWITCHES, AND GROUND SWITCHES", issued Apr. 27, 1971 and also assigned to the same assignee as the present invention, discloses another type of metal-enclosed switchgear comprising drawer mounted fuses and fuse isolator switches and grounding switches. However, the prior art arrangements have not provided for isolation of the fuses and removal of the fuses by a single error-free operation.

Consequently, it would be a desirable advance in the art to provide an isolating interrupter switch operating mechanism which is operated by an insulated tool which may also be utilized to engage and remove fuses from metal-enclosed switchgear so that the fuses may be removed in a single error-free operation.

BRIEF DESCRIPTION OF THE INVENTION

The present invention pertains to a high voltage interrupter switch mechanism for use in conjunction with an insulated tool. The switch mechanism comprises a stationary contact connected to one side of an electrical circuit. A movable contact means is connected to the other side of the circuit and is mounted for movement in a first direction to electrically disengage the stationary contact and in a second direction to electrically engage the stationary contact. Spring means are provided for spring biasing the movable contact means in either the first or second directions. A tool engaging means is provided for engaging the tool and being rotated by the tool in a first and second direction. Cam means is operably connected to the tool engaging means and moves in a first or a second direction in response to rotation of said tool engaging means in either the first or second directions. Biasing means are operably connected to the cam means for biasing the spring means in the direction of and in response to movement of the spring means in the direction of and in response to movement of the cam means. Cam follower means are provided to retain the movable contact in a stationary position against the spring biasing of the spring means until the cam means has biased the spring means. The cam follower means then releases the movable contact means so that the movable contact means can rapidly move to disengage the stationary contact when the tool is rotated in the first direction and engage the stationary contact when the tool is rotated in the second direction.

Fuse engaging contact means may also be operably connected to the tool engaging means so that rotation of the tool in the first direction causes the fuse contact means to electrically disengage a fuse and rotation of the tool in the opposite direction causes the fuse contact means to electrically engage the fuse.

Thus, it is a primary object of the present invention to provide a quick-make, quick-break interrupter switch mechanism for use to interrupt electrical current which is operated by rotation of an appropriate tool.

It is yet another object of the present invention to provide an interrupter switch mechanism that may be used in high voltage metal-enclosed switchgear in conjunction with a drawout type fuse so that the fuse may be isolated from the supply circuit and removed from the metal-enclosed switchgear by the use of a single insulated tool.

It is yet another object of the present invention to provide an interrupter switch mechanism which also operates fuse engaging contacts to cause the fuse engaging contacts to disengage the fuse when the switch is opened and engage the fuse when the switch is closed.

These and other objects, advantages, and features of the present invention will hereinafter appear, and for the purposes of illustration, but not of limitation, an exemplary embodiment of the present invention is illustrated in the attached drawings.

DETAILED DESCRIPTION OF THE PREFERRED EMBODIMENT

Figure 1:
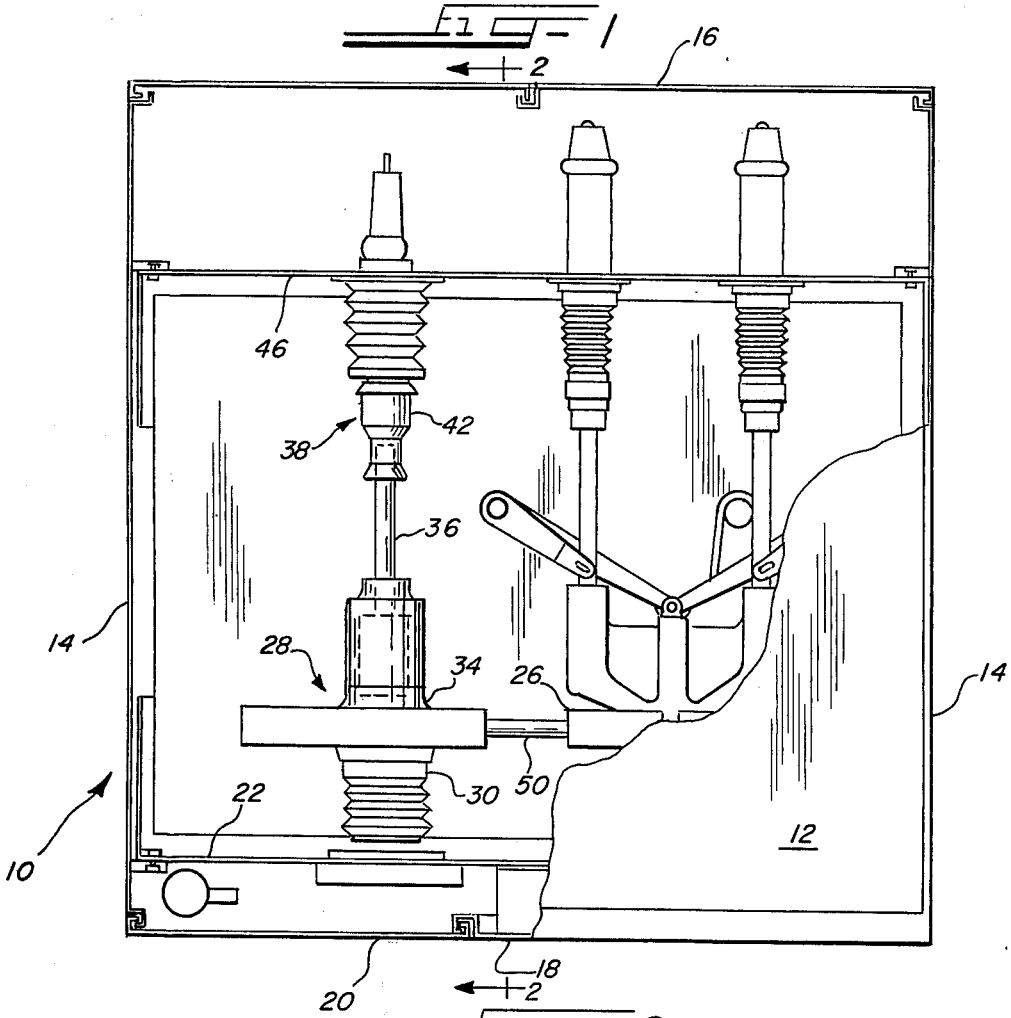
FIG. 1 is a top partially fragmentary view of the metal-enclosed switchgear having the embodiment of the present invention mounted therein.
Figure 2:
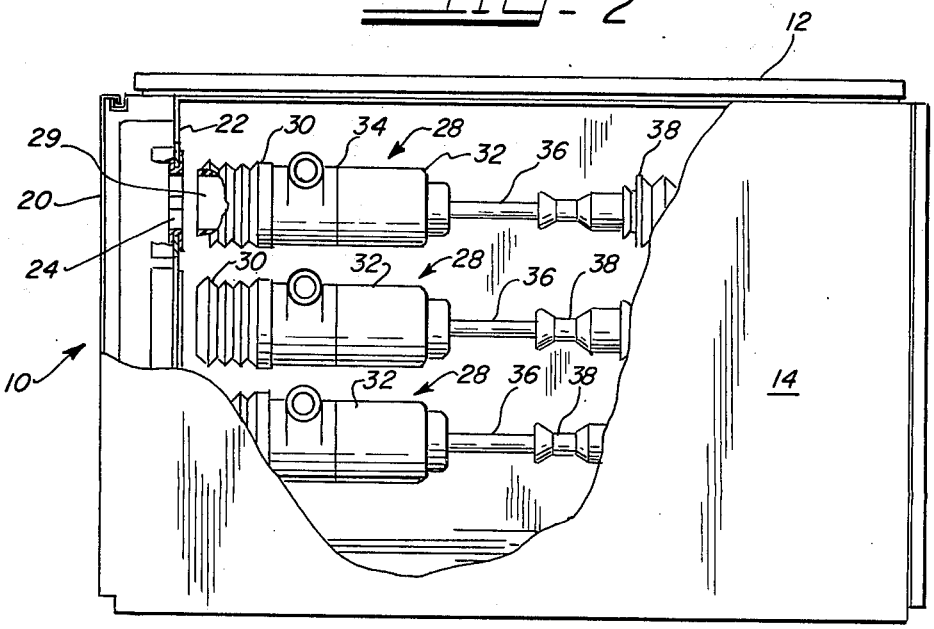
FIG. 2 is a right side partially sectional and fragmentary view of the metal-enclosed switchgear and embodiment illustrated in FIG. 1.

With reference to FIGS. 1 and 2, metal-enclosed switchgear 10 comprises a metal housing including top wall 12, side walls 14, back wall 16, front wall 18, and front door 20. Positioned within inside front door 20 is front panel 22 having access ports 24 formed therethrough (see FIG. 2).

Mounted within switchgear 10 are three stationary contacts 26 (only one shown) that are normally connected to each phase of a high voltage supply circuit. Also mounted within switchgear 10 are three switch mechanism assemblies 28. All three switch mechanism assemblies 28 are identical, so only one will be described.

Switch mechanism assembly 28 comprises hollow front insulator 30 having a hollow interior 29 that aligns with access port 24. Switch mechanism assembly 28 also comprises hollow rear insulator 32.

Figures 3, 8, 9:
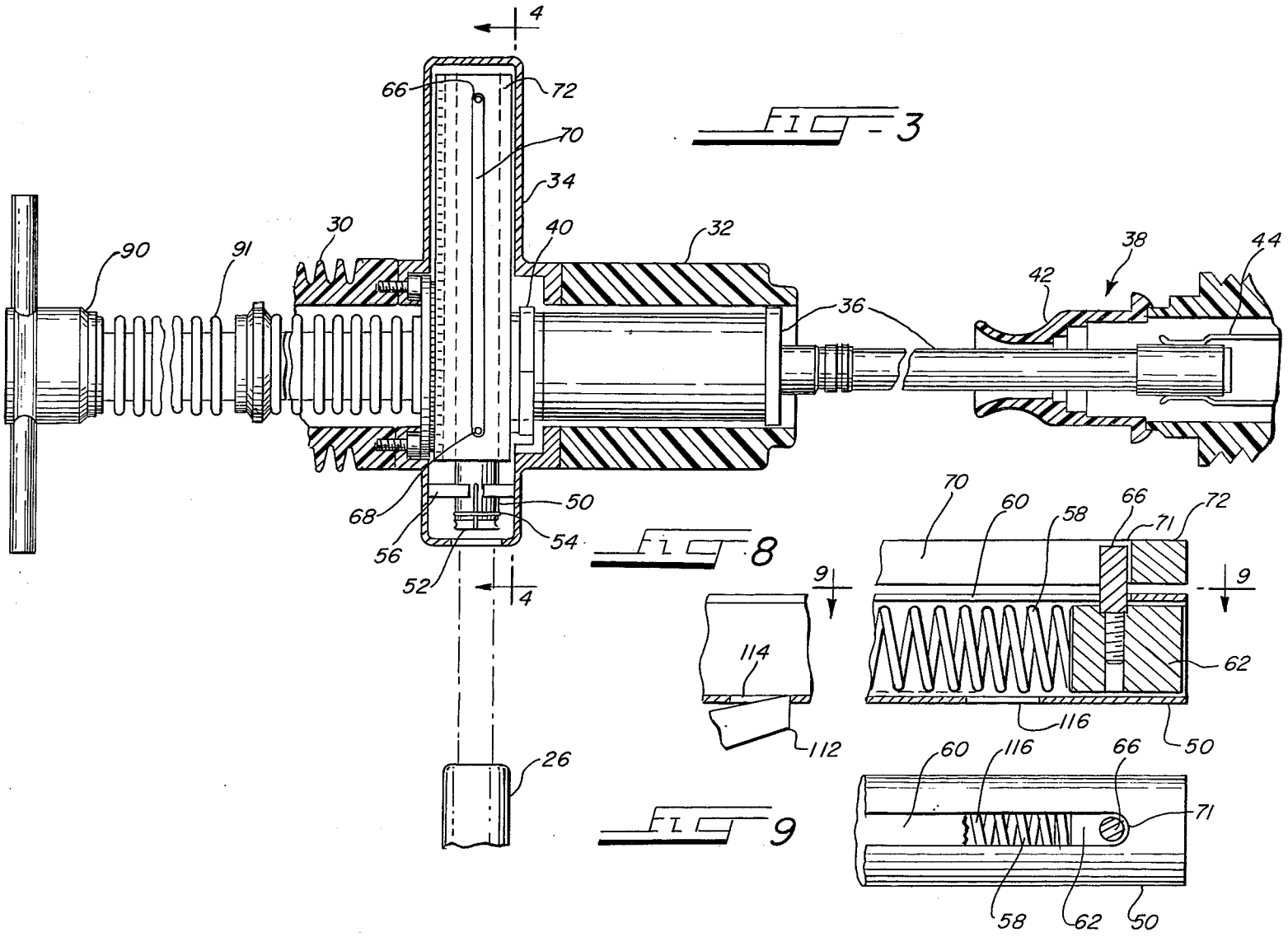
FIG. 3 is a top cross sectional partially fragmentary view of the preferred embodiment of the present invention, the sectional portion being taken substantially along line 2—2 in FIG. 1.
FIG. 8 is a cross sectional partially fragmentary view of the switch blade and cam plate showing one of the spring charging plugs.
FIG. 9 is a partially fragmentary top view taken substantially along line 9—9 in FIG. 8.

With reference to FIG. 3, mounted between front and rear insulators 30 and 32 is switch housing 34. Positioned inside the hollow interior of rear insulator 32 is a fuse 36 electrically connected between first fuse contact assembly 38 and second fuse contacts 40. First contact fuse assembly 38 comprises hollow insulator sleeve 42 and first fuse contact 44 which engages the end of fuse 36. First fuse contact assembly 38 is mounted to interior wall 46 within switchgear 10. Typically, fuse contact 44 is connected to an electrical load circuit.

Figures 4, 7:
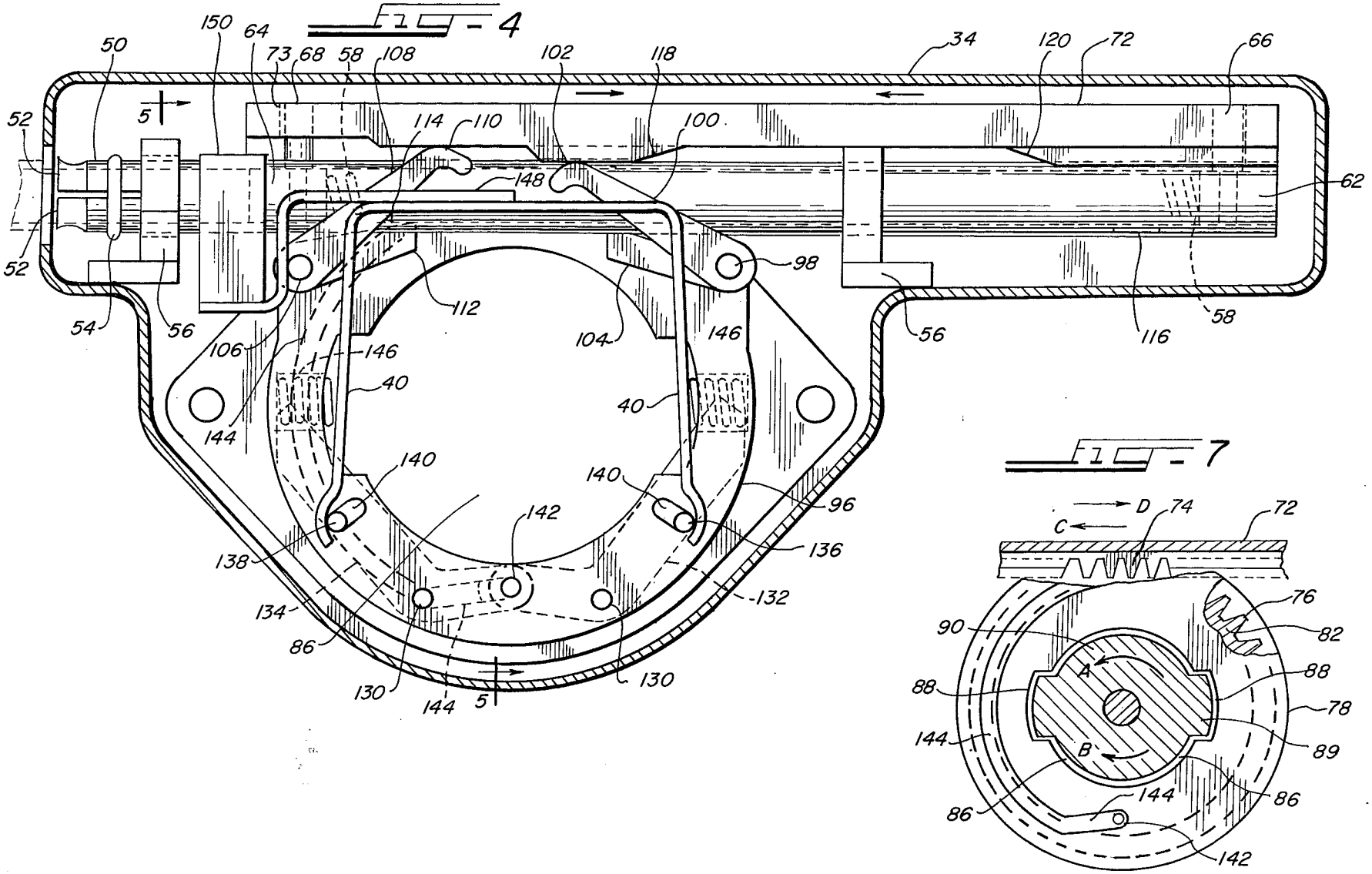
FIG. 4 is a rear partially cross sectional view of the preferred embodiment of the present invention taken substantially along line 4—4 in FIG. 3.
FIG. 7 is a cross sectional partially fragmentary view taken substantially along line 7—7 in FIG. 5.

With reference to FIGS. 3 and 4, positioned within switch housing 34 is tubular switch blade 50. Tubular switch blade 40 has a contact head at one end comprising contact fingers 52 that are biased towards one another by spring 54. Switch blade 50 is supported for linear movement by guides 56 which permit switch blade 50 to move in a linear direction to engage and disengage stationary contact 26.

Positioned within the hollow interior of switch blade 50 is spring 58. Formed through the top of switch blade 50 is slot 60 (see FIGS. 8 and 9) which extends from end 71 adjacent one end of switch blade 50 along its length to end 73 adjacent the contact head end of switch blade 50.

Positioned within the hollow interior of switch blade 50 is first spring plug 62 and second spring plug 64. Spring plugs 62 and 64 are dimensioned to slide within switch blade 50. Spring 58 is positioned between first spring plug 62 and second spring plug 64. Thread mounted into first and second spring plugs 62 and 64 are pins 66 and 68 which extend through slot 60 in switch blade 50 at each end of slot 60.

Figure 5:
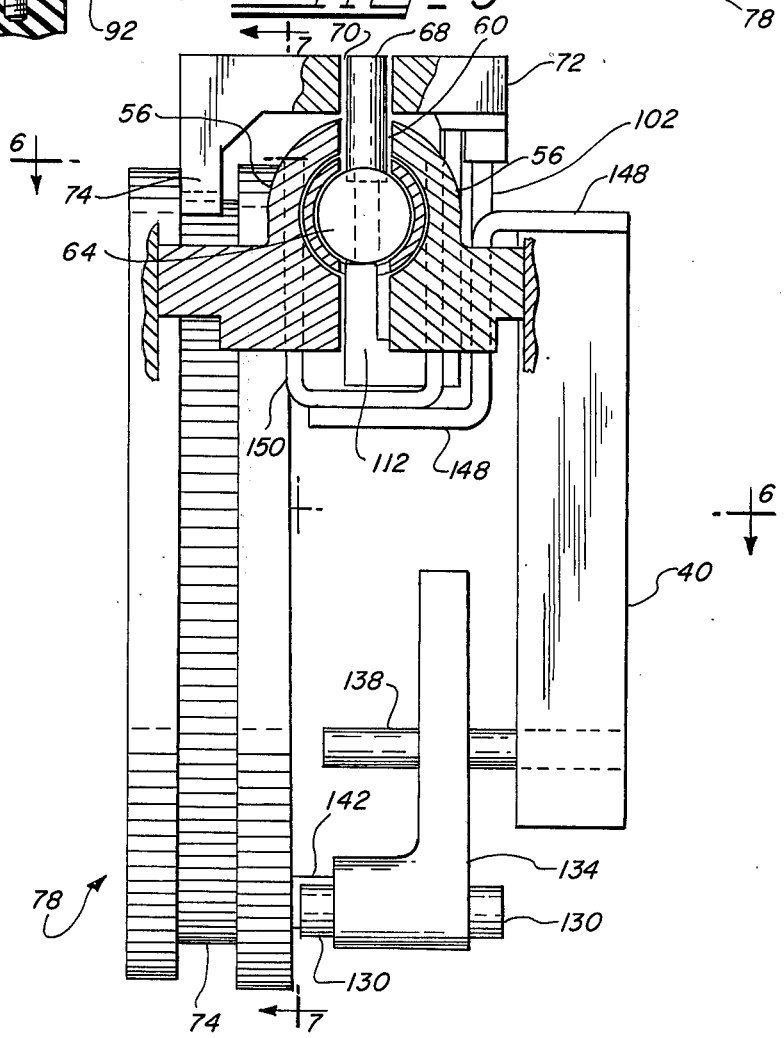
FIG. 5 is a side view of the operating portions of the present invention taken substantially along line 5—5 in FIG. 4 deleting the housing.

Pins 66 and 68 extend into a slot 70 formed through a cam plate 72. Cam plate 72 has an essentially flat top but has extending downwardly from one edge thereof gear teeth 74 (see FIGS. 5 and 7) that engage mating teeth 76 on gear disk 82 of disk assembly 78. Disk assembly 78 comprises cover disk 80, gear disk 82 and cam disk 84 (see FIGS. 5 and 6) mounted together to form a unitary disk assembly 78 having an opening 86 formed therethrough dimensioned to receive an appropriate tool 90. Formed along opposite edges of opening 86 are indentations 88 (see FIG. 7) which are dimensioned to receive engaging tabs 89 on tool 90 so that rotation of tool 90 causes disk assembly 78 to rotate.

Figure 6:
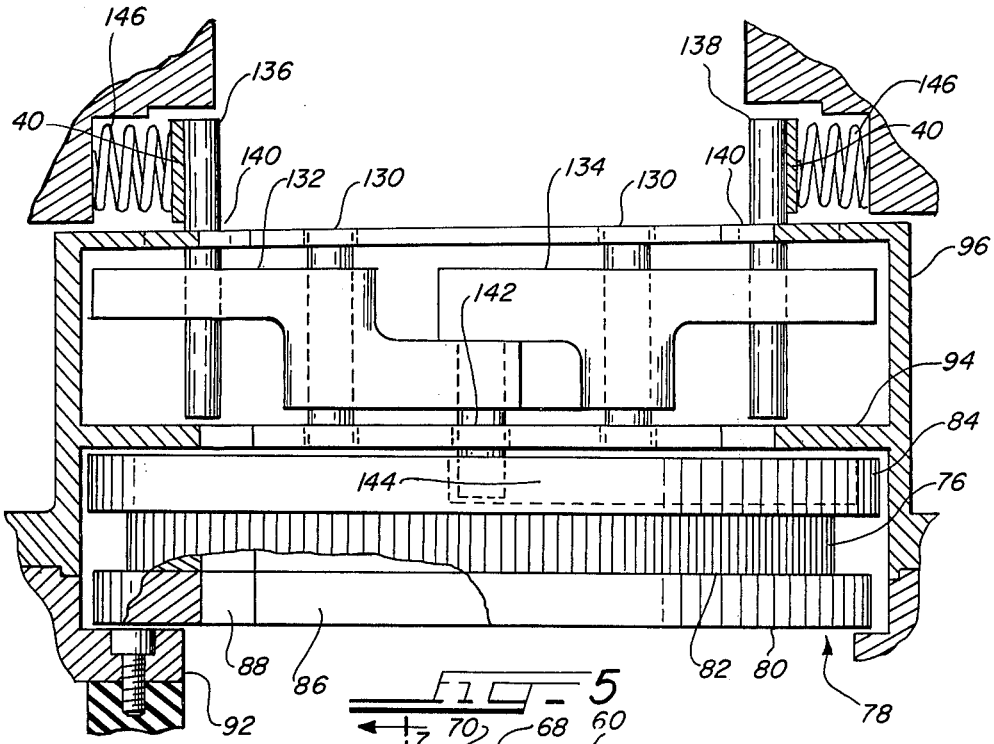
FIG. 6 is a top view of a portion of the operating mechanism taken substantially along line 6—6 in FIG. 5 but showing a portion of the housing.

Disk assembly 78 is positioned within switch housing 34 between a flange 92 and flange 94 of fuse contact housing 96 so that disk assembly 78 can freely rotate within housing 34 (see FIG. 6).

Also mounted to fuse contact housing 96 by pin 98 is first cam follower 100 (see FIG. 4). First cam follower 100 comprises follower arm 102 and stop arm 104. Also mounted to fuse contact housing 96 by pin 106 is second cam follower 108. Second cam follower 108 comprises follower arm 110 and stop arm 112. Stop arm 112 is positioned to engage opening 114 in the bottom of and adjacent the contact head end of switch blade 50 when switch blade 50 is in the position illustrated in FIG. 4 (see FIGS. 4 and 8). Switch blade 50 also has an opening 116 in the bottom of and adjacent the other end dimensioned to receive stop arm 104 when switch blade 50 is moved linearly to the left as viewed in FIG. 4.

Formed on the edge of and extending downwardly from cam plate 72 are first cam surface 118 and second cam surface 120. First cam surface 118 is formed toward one end of cam plate 70 and is positioned to engage follower arm 102 on first cam follower 100 to pivot cam follower 100 downwardly as shown in FIG. 4. Second cam surface 120 is formed toward the other end of cam plate 72 and is positioned to engage follower arm 110 on second cam follower 108 to pivot second cam follower 108 downwardly when cam plate 70 is moved to the left as viewed in FIG. 4.

Pivotably mounted to fuse contact housing 96 by pins 130 are contact latch arms 132 and 134. Mounted at one end of latch arms 132 and 134 are fuse contact engaging shafts 136 and 138. Shafts 136 and 138 extend through openings 140 in fuse contact housing 96 and engage second fuse contact 40. The opposite ends of latch arms 132 and 134 are pivotably connected by a follower shaft 142 which extends into a cam groove 144 formed in cam disk 84 (see FIGS. 4 and 7). Cam groove 144 is formed so that as cam disk 84 rotates cam groove 44 will cause contact latch arms 132 and 134 to pivot outwardly to the position illustrated in FIG. 4 so that contact engaging shafts 136 and 138 engage second fuse contact 40 causing second fuse contact 40 to spread outwardly to disengage fuse 36. However, as cam disk 84 is pivoted in the opposite direction, cam groove 144 causes latch arms 132 and 134 to pivot inwardly thereby allowing springs 146 to bias second fuse contact 40 inwardly thereby allowing springs 146 to bias second fuse contact 40 inwardly to engage fuse 36.

Second fuse contacts 40 are mounted on one end of support arm 148. Mounted on the other end of support arm 148 is switch blade engaging contacts 150 which slidably engage switch blade 50 throughout its range of linear movement so that a positive electrical connection is made between switch blade 50 and second fuse contacts 40 at all times.

Tool 90 may take the form of any tool having an insulator 91 that insulates the handle from the charged electrical portions within the switch-gear and which may be inserted into the switchgear to engage disk assembly 78. However, preferably, tool 90 takes the form of a specially adapted tool that may be used not only to engage disk assembly 78 and rotate disk assembly 78, but also to engage the end of fuse 36 as it is rotated so that fuse 36 can be withdrawn from the switchgear. The exact configuration of such a specially adapted tool does not form a part of the present invention and is the subject of a separate co-pending application assigned to the same assignee as the present invention. Further, tool 90 may take the form of any insulated member such as a shaft or other elongated member that may engage and rotate disk assembly 78.

To operate switch mechanism assembly 28, tool 90 is inserted through access port 24 into hollow front insulator 30 until the end of tool 90 engages disk assembly 78 as illustrated in FIG. 7. With tool 90 in this position, tool 90 is rotated in the direction of arrow A in FIG. 7, which causes gear teeth 76 on disk assembly 78 to drive gear teeth 74 on cam plate 72 causing cam plate 72 to move in the direction of arrow C in FIGS. 7 and 4. The movement of cam plate 72 in the direction of arrow C causes the end 71 of slot 70 in cam plate 72 to engage pin 66 attached to first spring plug 62 (see FIG. 8) moving first spring plug 62 within switch blade 50 to compress spring 58. However, since stop arm 112 is engaging opening 114 in switch blade 50, switch blade 50 is held in a stationary position against the spring biasing of spring 58. Spring 58 is continued to be compressed as cam plate 72 moves in the direction of arrow C until second cam surface 120 engages follower arm 110 of second cam follower 108 causing second cam follower 108 to pivot downwardly (as viewed in FIG. 4) to disengage stop arm 112 from opening 114 in switch blade 50. When stop arm 112 disengages opening 114, switch blade 50 is released and moves very rapidly under the spring biasing of spring 58 to close into stationary contact 26 thereby completing an electrical circuit. Stationary contact 26 may take a variety of forms and any stationary contact capable of mating with switch blade 50 will suffice. However, preferably stationary contact 20 includes an arc suppressor to suppress the arc formed when the contacts open or close.

Also, as disk assembly 78 is rotated by tool 90, cam disk 84 is also rotated so that cam groove 144 causes latch arms 132 and 134 to pivot inwardly as viewed in FIG. 4 so that second fuse contact 40 will be moved inwardly under the urging of springs 146 to make electrical connection with fuse 36. In this position, an electrical circuit is then formed from stationary contact 26 through switch blade 50, switch blade engaging contacts 150, support arm 148, and fuse contacts 40 to one end of fuse 36. This completes a circuit from the electrical supply circuit through fuse 36 to the electrical load circuit.

To open the circuit, tool 90 is rotated in the direction of arrow B in FIG. 7 which causes cam plate 72 to move in the direction of arrow D. When switch blade 50 is closed into stationary contact 26, as previously described, a first cam follower 100 pivots upwardly as first cam surface 118 disengages follower arm 102 so that stop arm 104 can engage opening 116 in switch blade 50. Thus, as cam plate 72 is moved in the direction of arrow D, second spring plug 64 is moved to compress spring 58 in the opposite direction as the end 73 of slot 70 engages pin 68. Spring 58 continues to be compressed until first cam surface 118 on cam plate 72 engages follower arm 102 causing first cam follower 100 to pivot downwardly disengaging stop arm 104 from opening 116 in switch blade 50. Switch blade 50 is then released and moves very rapidly to disengage stationary contacts 26 and move to the position illustrated in FIG. 4.

Similarly, as disk assembly 78 is rotated in the direction of arrow B, cam disk 84 is rotated until cam groove 44 pivots latch arms 132 and 134 outwardly as viewed in FIG. 4 to cause second fuse contacts 40 to move outwardly to disengage fuse 36. At this point, fuse 36 is isolated from the electrical supply circuit connected to stationary contact 26 so that fuse 36 can be withdrawn from the switchgear without causing an electrical arc.

Thus, the switch mechanism of the present invention provides a means of rapidly opening and rapidly closing a switch blade into a stationary contact by rotation of an appropriate insulated tool in the appropriate direction. Further, the present invention provides an arrangement for electrically engaging and disengaging the fuse as the switch blade is closed or opened so that the fuse can be withdrawn from the switchgear.

It should be expressly understood that various changes and modifications may be made to the structure of the embodiment illustrated herein without departing from the spirit and scope of the present invention as defined in the appended claims.

I claim:

1. A high voltage switch mechanism for use in conjunction with an insulated member, said switch mechanism comprising:

a stationary contact connected to one side of an electrical circuit;

movable contact means connected to the other side of an electrical circuit mounted for movement in a first direction to electrically disengage said stationary contact, and in a second direction to engage said stationary contact;

spring means for spring biasing said movable contact means in either the first or the second direction;

insulated member engaging means for engaging the insulator member and being rotated by the insulated member, in a first and a second direction;

cam means operably connected to said insulated member engaging means for moving in a first direction in response to rotation of said insulated member engaging means in the first direction and for moving in a second direction in response to rotation of said insulated member engaging means in the second direction;

biasing means operably connected to said cam means for biasing said spring means in the direction of and in response to movement of said cam means;

cam follower means for retaining said movable contact means in a stationary position against the spring biasing of said spring means until said cam means has biased said spring means, and for then releasing said movable contact means so that said movable contact means can rapidly move to disengage said stationary contact when the insulated member is rotated in the first direction and engage said stationary contact when the insulated member is rotated in the second direction.

2. A switch mechanism, as claimed in claim 1, wherein said movable contact means comprises a hollow tubular member having spring biased fingers at one end thereof for engaging said stationary contact, said tubular member having a slot formed along the length thereof, and first and second engaging openings adjacent opposite ends thereof positioned to engage said cam means.

3. A switch mechanism, as claimed in claim 2, wherein said insulated member engaging means comprises a rotatably mounted disk having an opening formed therethrough for receiving and engaging the insulated member, said disk having first driving means formed around the periphery thereof.

4. A switch mechanism, as claimed in claim 3, wherein said cam means comprises a plate member mounted for linear movement having second driving means formed thereon for cooperating with the first driving means on said disk so that said plate member moves when said disk is rotated, said plate member having a slot formed therein aligning with the slot in the hollow tubular member, and said plate member having first and second cam surfaces formed thereon.

5. A switch mechanism, as claimed in claim 4, wherein said spring means comprises a spring positioned within said tubular member; and said biasing means comprises:

a first plug member dimensioned to slide within said tubular member, said plug member having a pin extending therefrom into the slots in said tubular member and said plate member;

a second plug member dimensioned to slide within said tubular member, said plug member having a pin extending therefrom into the slots in the tubular member and the plate member, said spring being positioned between said first and second plug members.

6. A switch mechanism, as claimed in claim 5, wherein said cam follower means comprises:

a pivotably mounted first follower member having a first following arm for engaging the first cam surface on said plate member and a stop arm for engaging the first identation in said tubular member;

a pivotably mounted second follower member having a following arm for engaging the second cam surface on said plate member and a stop arm for engaging the second indentation in said tubular member.

7. A switch mechanism, as claimed in claim 1, further comprising fuse contact means operably connected to said insulated member engaging means for disengaging a fuse contact from a fuse when said insulated member engaging means is rotated in the first direction and engaging the fuse contact to the fuse when said insulated member engaging means is rotated in the second direction.

8. A high voltage switch mechanism for use in conjunction with an insulated tool for engaging and removing a fuse from high voltage metal-enclosed switchgear, one end of the fuse being connected to a load circuit, said switch mechanism comprising:

a stationary contact connected to a high voltage supply circuit;

a movable contact means mounted for movement in a first direction to electrically disengage said stationary contact, and in a second direction to engage said stationary contact;

fuse contact means electrically connected to said movable contact means, said fuse contact means for engaging the other end of the fuse;

spring means for spring biasing said movable contact means in either the first or second direction;

tool engaging means for engaging the tool and being rotated by the tool in a first and a second direction;

cam means operably connected to said tool engaging means for moving in a first direction in response to rotation of said tool engaging means in the first direction, and for moving in a second direction in response to rotation of said tool engaging means in the second direction;

biasing means operably connected to said cam means for biasing said spring means in the direction of and in response to movement of said cam means;

cam follower means for retaining said movable contact means in a stationary position against the spring biasing of said spring means until said cam means has biased said spring means, and for then releasing said movable contact means so that said movable contact means can rapidly move to disengage said stationary contact when the tool is rotated in the first direction and engage said stationary contact when the tool is rotated in the second direction.

9. A switch mechanism, as claimed in claim 8, wherein said fuse contact means is operably connected to said tool engaging means so that rotation of said tool engaging means in the first direction causes said fuse contact means to disengage said fuse, and rotation of said tool engaging means in the second direction causes said fuse engaging means to engage said fuse.

10. A high voltage interrupter switch mechanism for use in conjunction with an insulated tool for engaging and removing a fuse from high voltage metal-enclosed switchgears, said switch mechanism comprising:

a stationary contact connected to a high voltage supply circuit;

a hollow tubular contact mounted for linear movement into and out of electrical connection with the stationary contact; said movable contact having a slot formed along its length and first and second engaging means formed adjacent opposite ends thereof;

a fuse contact electrically connected to the movable contact and being connectable to one end of the fuse;

a rotatably mounted disk having an opening therein for receiving the tool and being rotated by the tool in a first and second direction, said disk having first driving means formed around the periphery thereof;

a cam plate member mounted for linear movement and having second driving means formed thereon for mating and engaging the first driving means on said disk and being moved when said disk is rotated, said plate member having a slot formed therein aligning with the slot in said movable contact, and said plate member having first and second cam surfaces formed thereon;

a first plug member positioned within said movable contact having a pin extending therefrom into the slots in said movable contact and said plate member, said first plug member being movable within said movable contact;

a second plug member positioned within said movable contact having a pin extending therefrom into the slots in said movable contact and said plate member, said second plug member being movable within said movable contact;

a spring positioned within said movable contact between said first and second plug members;

a first pivotably mounted follower member having a first follower arm for engaging the first cam surface on said cam plate member and a first stop arm for engaging the first engaging means on said movable contact;

a second pivotably mounted follower member having a second follower arm for engaging the second cam surface on said cam plate member and a second stop arm for engaging the second engaging means on said movable contact;

whereby rotation of said tool engaging means in the first direction by the tool causes said plate member to move said first plug member to bias said spring in the first direction until said first cam surface on said cam plate member causes said first stop arm to disengage said first engaging means causing said movable contact to move to rapidly disengage said stationary contact, and rotation of said tool engaging means in the second direction by said tool causes said plate member to move said second plug member to bias said spring in the second direction until said second cam surface on said cam plate causes said second stop arm to disengage said second engaging means causing said movable contact to move to rapidly engage said stationary contact.

11. A high voltage switch mechanism, as claimed in claim 10, further comprising:

a first pivotably mounted latch arm engaging said fuse contact;

a second pivotably mounted latch arm engaging said fuse contact;

a follower shaft interconnecting said latch arms, said follower shaft engaging a cam groove in said disk so that rotation of said disk in the first direction causes said latch arms to pivot in a first direction to cause said fuse contact to disengage the fuse, and so that rotation of said disk in the second direction causes said latch arms to pivot in a second direction to cause said fuse contact to engage the fuse.

* * * * *